US005873573A

United States Patent [19]

Beatty, Jr.

[11] Patent Number: 5,873,573

[45] Date of Patent: Feb. 23, 1999

[54] RING TOSS GAME WITH BELL SOUNDS

[76] Inventor: William H. Beatty, Jr., 6336 Blanchard Rd., La Mesa, Calif. 91942

[21] Appl. No.: 901,268

[22] Filed: Jul. 28, 1997

[51] Int. Cl.[6] ..... A63B 67/06

[52] U.S. Cl. ..... 273/336

[58] Field of Search ..... 273/336, 337, 273/338, 339, 398, 399, 400, 401, 402

[56] References Cited

U.S. PATENT DOCUMENTS

| | | | |
|---|---|---|---|
| 593,343 | 11/1897 | Whitney | 273/400 |
| 2,917,311 | 12/1959 | Yurket | 273/336 |
| 3,119,619 | 1/1964 | Frank | 273/336 |
| 4,982,966 | 1/1991 | Teafatiller | 273/338 |
| 5,040,801 | 8/1991 | Weymuth | 273/338 |
| 5,052,693 | 10/1991 | Hicks | 273/336 |
| 5,110,139 | 5/1992 | Baumgartner | 273/400 |

*Primary Examiner*—William H. Grieb
*Attorney, Agent, or Firm*—Frank D. Gilliam

[57] ABSTRACT

A ring-toss type game having a target made up of a generally tubular wall on a base with an upstanding central post, the target made from a hard heavy material such as steel that will produce a bell-like sound when struck by ring formed from a hard material such as steel. The target wall and base may be a single unitary cup shaped member or may consist of a wall fastened to the base. An elastic band, such as a Bungee cord, may be wrapped around the wall to reduce impact sound intensity. A cord and bracket assembly may be secured to the target to be stretched away from the target and secured to the ground to provide a clear line behind which rings will be pitched or tossed at the target. Typically, tossing a ring over the post will earn the highest number of points, a lesser number will be earned by tossing a ring into the target between the post and inner wall and the least number of points for striking the target exterior.

14 Claims, 2 Drawing Sheets

RING TOSS GAME WITH BELL SOUNDS

FIELD OF THE INVENTION

This invention relates to games of the horseshoes or ring toss type, in which a ring or the like is pitched or thrown towards a post so that the ring ends up over the post or close to the post.

BACKGROUND OF THE INVENTION

The game now known as "horseshoes" originated in Roman army camps about A.D. 100. Horseshoe pitching has long been popular in the United States and Canada. A national association has established regulations for the game. Regulation horseshoes are approximately seven inches wide and long and weigh about two pounds, 10 ounces. The pitching court has two iron stakes embedded into the ground. Generally a box like area of softened earth or sand surrounds each stake. The pitching court typically has a width of about 10 feet and a distance between stakes of about 30 feet. Scoring is based on "ringers" that surround the stake. "leaders" that lean against a stake and horseshoes that lie within about six inches of the stake.

Horseshoe pitching is widely enjoyed, especially in rural areas. In urban areas, parks, etc. it is difficult to set up a temporary court, since it is necessary to pound the stakes very firmly into the ground and the damage the thrown horseshoes do to the area around each stake. Also, children, women and older people have difficulty in pitching the quite heavy horseshoes.

Games having some of the attributes of horseshoes have been developed for use in parks and yards where installing horseshoe stakes is difficult and damage to the surface is unacceptable. Generally these are some type of "ring toss" game, in which a wooden stake on a base, a box with openings or a similar target is used and lightweight rings of wood, plastic, rope and the like are tossed at the target. These games are suitable for children or persons without the strength for horseshoe pitching and can be set up anywhere without damage to the environment.

Ring toss games, however, are generally considered children's games and are not often played by adults. The lightweight rings do not give the "feel" of horseshoes. The "clang" of horseshoes against a stake, indicating a good pitch, which adds an audible factor to horseshoes is missing from ring toss games. Further, where the target stake is not secured in place, such as being mounted on a light base board rather than being pounded into the ground, the stake and board will tend to move or tip over when struck by a vigorously thrown ring.

Thus, there is a continuing need for games having the feel of horseshoes without the need for a complex court and that can easily set up and played in yards, parks, while camping, etc. without significantly damaging the area around the targets.

SUMMARY OF THE INVENTION

The above-noted problems, and others, are overcome in accordance with this invention by a ring toss game basically comprising a target member having a base and an upstanding, approximately tubular, wall, an upstanding post approximately centrally located on the base within the wall and a plurality of metal rings sized to fit over the post and between post and wall.

In use, players stand at a selected distance from the target member and toss the rings toward the post. Any desired scoring system may be used. Typically, a "ringer" that settles around the post will count the most points, a ring that falls into the target member between post and wall will count an intermediate number of points and a ring that strikes the outer wall will count fewer points.

The base and wall are formed from a metal or ceramic material that will produce a loud bell-like sound when struck by a ring. Preferably, a metal such as steel is used to produce an optimum sound. If desired, other materials, such as ceramics, plastics, softer metals such as aluminum could be used if optimized to produce the bell-like sound. Rings may be provided in sets, typically four in each set, with distinguishing indicia. For example, the rings may be colored differently, by paint, anodizing in the case of aluminum rings, surface plating with different colored metal, e.g. brass and nickel or may have bands of different colors, which would provide a wide variety of color combinations. Any suitable ring diameter and cross section may be used. Rings may have square, round, elliptical or any other desired cross section. Round and square cross sections are generally preferred for ease of manufacture.

Any suitable rings may be used. For best results, a metal such as steel or another very hard material that will produce an effective bell-like sound when the target member is struck is preferred. Where a quiet game is occasionally desired, rings of softer material such as rubber or plastic could be used, although this severely reduces one of the most desirable features of this game; namely, the bell-like impact sound. Any suitable ring shape may be used. For best results, rings having a circular cross section are preferred, although disk-like rings having a central hole may be used. The rings, while much lighter than horseshoes, will have sufficient weight to give a good "feel" when tossed.

Where it is desired to retain the bell-like impact sound, but to reduce sound intensity, an elastic band can be placed around the target member, typically a conventional Bungee cord, a large rubber band or the like. The desired impact sound characteristics will remain, only at less intensity.

Any suitable target member having a base and an upstanding approximately tubular wall may be used. A one-piece cup like target member with the base and wall formed integrally gives excellent results. Alternatively, a tubular wall section could be secured to a base by welding or the like. In another embodiment, a plurality of upstanding pieces could be spaced around and secured to the base. The pieces could, if desired, have different thicknesses to produce different tones when different pieces are struck. The target member should have sufficient mass as to not be easily moved by ring impact.

In use, the target member is set down at a selected distance from a pitching line. A cord or rope may be fastened to the target member and have one or more brackets to hold an end portion of the cord at predetermined distances from the target member to provide uniform pitching positions. The players, in any selected order, will pitch their rings toward the target member. Rings may be marked with different colored paint bands, tape bands or other indicia. While the players may select any suitable scoring arrangement, typically a ringer may count for 3 points, a ring in the target member between the post and the interior surface 2 points and a ring that only impacts the exterior 1 point. After all the rings have been pitched a selected number of times, the scores are added up and a winner is declared.

With several brackets at different distances from the target member along the cord a number of variations in the basic ring toss game are possible. For example, children may pitch from a bracket closer to the target member and adults from more distant brackets.

Or, players could select the bracket to pitch from on each turn, with more points given for ringers, etc. made from the greater distances. With this arrangement, a player who is well behind the leader could pitch from the greatest distance to try to make up ground with higher scores. Of course, another strategy would be to always from the minimum distance to attempt a greater number, but lower scoring, of scoring pitches.

In another variation, players could all start from the bracket closest to the target member, then anyone making a ringer would move to the next further away bracket. When the player reaches the furthest bracket, he or she will move one bracket closer to the target member with each ringer. The winner will be the person who first returns to the nearest bracket.

With these and other variations to be originated by the players greater interest in the game will be developed.

Therefore, it is an object of this invention to provide a ring toss game having much of the "feel" of horseshoes, with rings and target of sufficient mass to give that "feel". Another object is to provide a ring toss game that can be used on lawns and the like without significantly damaging the area around the target. A further object is to provide a ring toss game with a target that is stable and resists movement when struck by a ring without being emplaced in the ground. Yet another object is to provide a ring toss game with the enhancement of producing a bell-like sound when the target is struck, with variable sound intensity.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
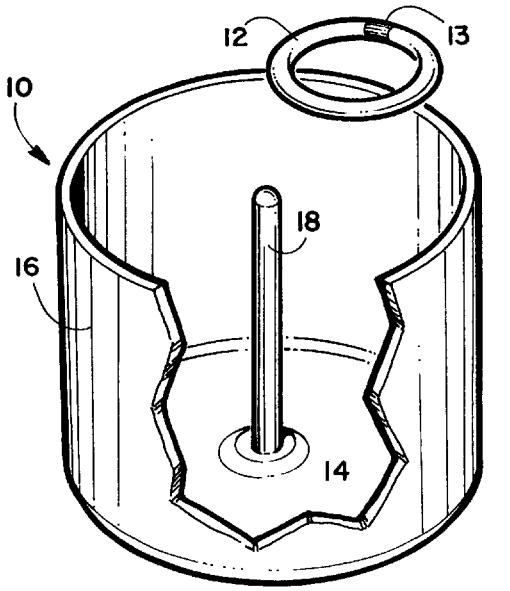
FIG. 1 is a perspective view of a first embodiment of the ring toss game target member and a ring.
Figure 2:
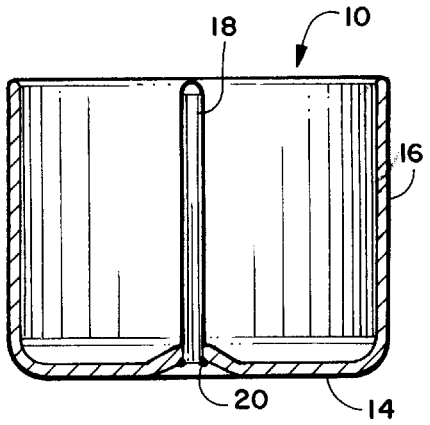
FIG. 2 is an axial section view taken on line 2—2 in FIG. 3.
Figure 3:
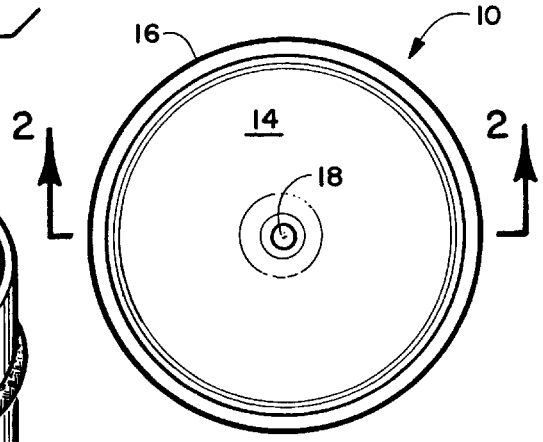
FIG. 3 is a plan view of the FIG. 1 embodiment.

Referring now to FIGS. 1–3, there is seen a perspective view of a first embodiment of a target member 10 and a ring 12. Target member 10 in this embodiment has a cup shape with base 14 and cylindrical wall 16 formed as a single, unitary structure surrounding a central post 18. While the cylindrical cross section as shown is preferred for wall 16, the wall could be square, elliptical or any other suitable shape. Wall 16 could be tapered outwardly and post 18 could be threaded into the base 14, permitting compact shipping of a number of games with posts 18 removed and the targets nested or stacked. Target member 10 may be formed from any suitable material. Metal is preferred for durability, stability and ease of manufacture. If desired, any other material that is heavy (to prevent excessive movement of target 10 when struck by a ring 12), durable and that will produce a bell-like ringing sound when struck by a ring may be used. Typical of such materials are ceramics, some very hard plastics, etc.

A post 18 is secured to base 14, preferably at the center of the base. For greatest strength and ease of manufacture, post 18 is preferably welded in hole 20 at the center of base 14. If desired, other fastening arrangements, such as providing threads along the proximal end of post 18 and on the interior of hole 20 to permit easy mounting and dismounting of the post.

Figure 4:
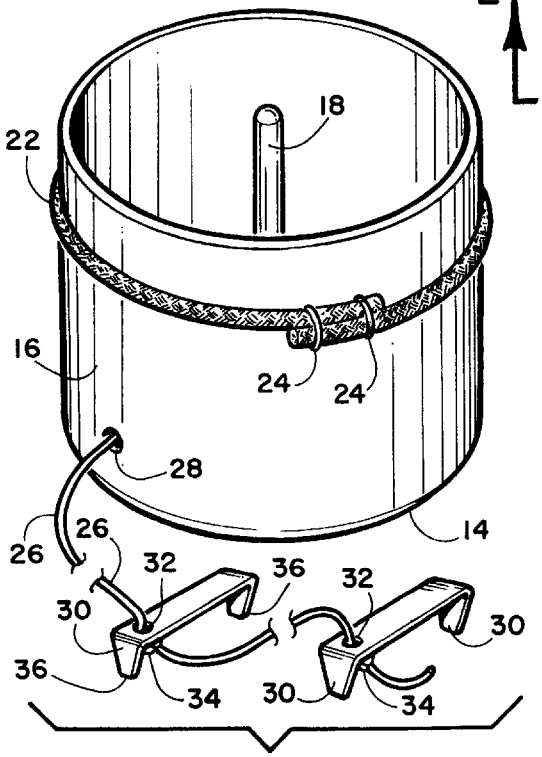
FIG. 4 is a perspective view of a second embodiment of the ring toss game target member.
Figure 5:
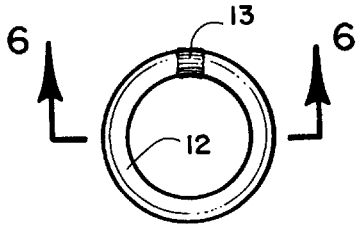
FIG. 5 is a plan view of a ring.
Figure 6:
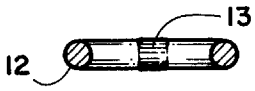
FIG. 6 is a section view of the ring, taken on line 6—6 in FIG. 5.

A second embodiment of target member 10 is shown in FIG. 4. The wall 16 and base 14 are substantially as shown in FIGS. 1–3. In this embodiment, in order to reduce the intensity of the bell-like sound generated by impact from a ring 12, one or more elastic bands 22 are stretched over wall 16. A quieter bell-like sound will then be generated by ring impact. Several bands 22 may be used to further reduce sound intensity. Any suitable elastic band may be used. The elasticity of band 22 will bring it into tight contact with the surface of wall 16 so that the sound reduction will be uniform around the wall. A length of Bungee cord, with a rubber core and a cloth covering, is highly effective. A length is cut, overlapped and slightly stretched and the ends are secured together with conventional wire clips 24. Large rubber bands or other elastic band may be used, if desired.

In order to establish a uniform pitching line, a cord 26 may be used, with one end extending into target member 10 through a hole 28. A knob or knot (not seen) may be provided on the interior end of cord 26 to prevent the entire cord from slipping through hole 28.

Two broadly U-shaped brackets 30 have holes 32 that are slipped over cord 26. Knots 34 are formed at selected locations along cord after brackets 30 are installed to prevent them from sliding off of the cord. In use, cord 26 is stretched away from target member 10, points 36 on the bracket 30 closest to the target member are pressed into the ground, typically by simply stepping on the brackets with the points extending downward. The remaining cord end is stretched along a line perpendicular to a line drawn from target member to the cord and the second bracket 30 is pressed into the ground. The length of cord between the two brackets thus establishes a line from behind which players will pitch or toss rings 12 towards target member 10. The brackets could bear stamped (preferably with paint filling the stamps) or painted numbers, have different colors or could be distinguished in other ways.

As described above, the cord 26 could extend straight away from target member 10, with the several brackets 30 each designating a different pitching line. Thus, children could pitch from a closer bracket and adults from a further bracket. Other games can be devised, such as those described above, in which players move from bracket to bracket to vary pitching distance.

Figure 9:
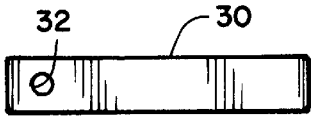
FIG. 9 is a plan view of a pitching line indicating bracket.
Figure 10:
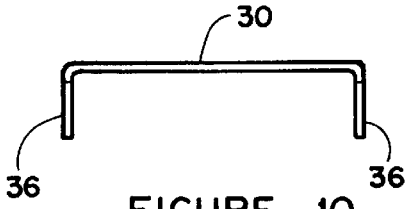
FIG. 10 is a side elevation view of the pitching line indicating bracket of FIG. 9.

If desired, knots 34 could be replaced with beads 38 fitting tightly over cord 26, so that the beads could be moved to adjust the positions of brackets 30 along cord 26. A tight friction fit of beads 38 over cord 26 is preferred so that the brackets would not be moved inadvertently. Details of the configuration of brackets 30, points 36 and holes 32 are provided in FIGS. 9 and 10.

Figure 7:
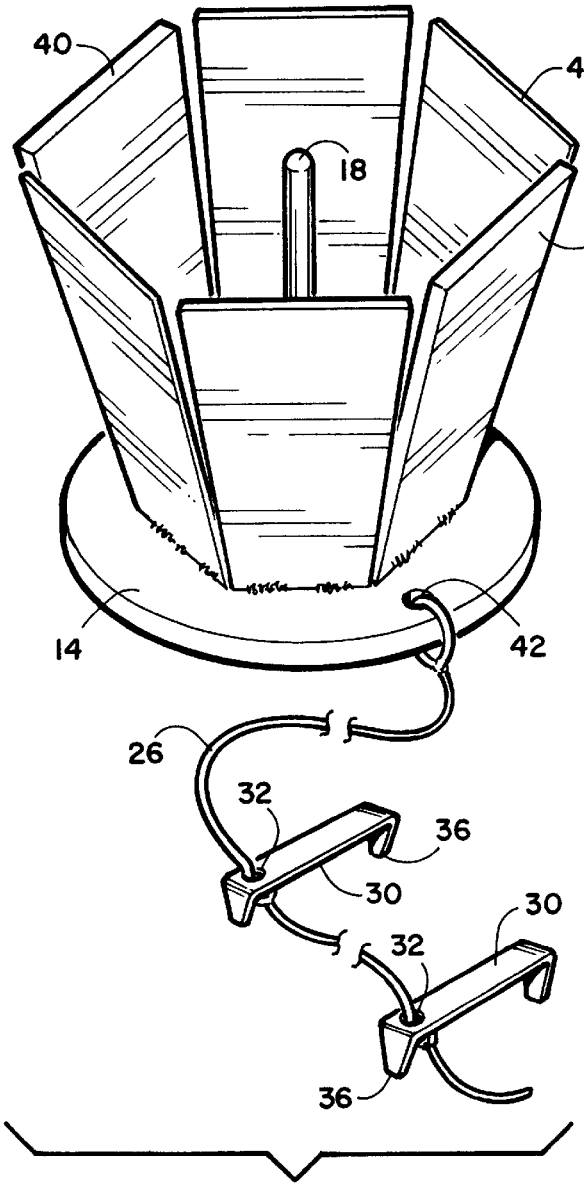
FIG. 7 is a perspective view of a third embodiment of the ring toss game target member.

A third embodiment of target member 10 is illustrated in FIG. 7. In this embodiment, the approximately tubular wall means is formed from a plurality of upstanding wall panels 40. Panels 40 are secured in an approximate circle (or other pattern, a circle being generally optimum) such as by welding. Panels 40 may be trapezoidal as shown and lean slightly outwardly as shown and separated by a narrow space. If desired, panels 40 could be rectangular and slope inwardly or outwardly or may be perpendicular to base 14.

An advantage of the embodiment of FIG. 7 is that different panels 40 could have different thicknesses or other varying dimensions to provide different bell-like sounds for different panels. This differing sound could be used in scoring, with more points given for striking a particular panel 40, such as the closest or furthest panel than for striking a side panel. Further, in this embodiment post 18 is preferably threaded into hole 20 (not seen in this view) so that the posts could be removed and a number of target members 10 could be nested for transport.

In the embodiment of FIG. 7, base 14 extends beyond the attachment line to the lower edges of panels 40, preferably to a diameter about equal to the circle formed by the upper edges of panels 40, for maximum stability in use.

Since base 14 extends beyond panels 40, a hole 42 is conveniently provided in the extended edge to receive a loop 44 for securing cord 25 to the target member 10.

Figure 8:
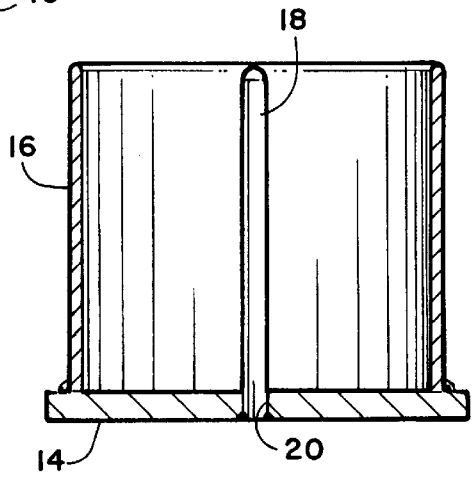
FIG. 8 is an approximately axial section view of a fourth embodiment of the ring toss game target member.

A fourth embodiment of target member 10 is illustrated in approximately axial section view in FIG. 8. Here, wall 16 is formed from a tubular section, which typically could be cut from a standard large diameter steel pipe. Wall 16 is secured, such as by welding, to base 14, which is in the form of a disk cut from steel or the like. Post 18 is inserted in a central hole 20 in base 14 and secured by welding, threads or the like.

In each of the embodiments shown and discussed above, dimensions such as height of walls 16, height of post 18 and diameter of the target member 40 may be varied as desired. Excellent results are obtained where post 18 has a height approximately the same as the wall height, the diameter of the target member is from about 6 to 10 inches, rings 12 have outside diameters of from about 3 to 5 inches with a cross section of about ⅜ to ½ inch and post 18 has a diameter of from about ½ to ¾ inch.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A ring-toss type game, which comprises:

a target member comprising a base and an upstanding approximately tubular wall means secured to said base;

said target member formed from a material that will produce a loud bell-like sound when struck;

a post secured to said base within said approximately tubular wall means and approximately perpendicular thereto; and a plurality of hard rings;

a band of elastic material having a predetermined diameter less than the diameter of said approximately tubular wall means, for fitting over said approximately tubular wall means to reduce the intensity of the bell-like sound resulting from ring impact against said approximately tubular wall means;

whereby said rings may be tossed toward said peg so that the rings may fall over said peg, may fall between said peg and said target member wall means or may impact said tubular member outer wall, in each case making a bell-like sound when said tubular member is struck by a ring.

2. The ring-toss type game according to claim 1 wherein said upstanding approximately tubular wall means is comprised of a plurality of spaced plates secured at one edge to said base.

3. The ring-toss type game according to claim 2 wherein said plates are angled outwardly from said base at angle to said base of from about 5 to 15 degrees.

4. The ring-toss type game according to claim 2 wherein at least some of said plates have different predetermined ringing characteristics to produce different tones when impacted.

5. The ring-toss type game according to claim 1 wherein said hard rings have cross sections selected from circular and rectangular cross sections.

6. The ring-toss type game according to claim 1 wherein said base and approximately tubular wall means are formed integrally in a generally cup-like configuration.

7. The ring-toss type game according to claim 1 further including additional rings of a less hard material so that a less intense bell-like sound will be produced by ring impact against said approximately tubular wall.

8. The ring-toss type game according to claim 1 further including:

an elongated cord;

means for securing a first end of said cord to said target member;

at least one bracket mounted along said cord at a predetermined location adjacent to a second end of said cord;

whereby said predetermined location indicates a predetermined position from which rings are tossed toward said target member.

9. The ring-toss type game according to claim 8 wherein at least two spaced brackets along said cord so that said brackets may be arranged along a straight line generally perpendicular to a line drawn from said target member to said straight line.

10. The ring-toss type game according to claim 8 further including means for securing each said at least one bracket to a ground surface.

11. A ring-toss type game, which comprises:

a target member comprising a base and an upstanding approximately tubular wall secured to said base;

said tubular wall comprising a plurality of spaced plates having different dimensions secured along an edge to said base so that different plates could have different predetermined ringing characteristics to produce different tones when impacted;

said target member formed from a material that will produce a loud bell-like sound when struck;

a post secured to said base within said approximately tubular wall and approximately perpendicular thereto; and a plurality of hard rings;

whereby said rings may be tossed toward said peg so that the rings may fall over said peg, may fall between said peg and said tubular wall or may impact an outer surface of said tubular wall, in each case making a bell-like sound when said tubular wall is struck by a ring.

12. The ring-toss type game according to claim 11 wherein said plates are angled outwardly from said base at angle to said base of from about 5 to 15 degrees.

13. The ring-toss type game according to claim 11 further including additional rings of a less hard material so that a less intense bell-like sound will be produced by ring impact against said approximately tubular wall.

14. The ring-toss type game according to claim 11 further including a band of elastic material having a predetermined diameter less than the diameter of said approximately tubular wall, whereby said band can be fitted over said approximately tubular wall to reduce the intensity of the bell-like sound resulting from ring impact against said approximately tubular wall.

* * * * *